US007828756B2

(12) United States Patent
Kamba et al.

(10) Patent No.: US 7,828,756 B2
(45) Date of Patent: Nov. 9, 2010

(54) MASSAGE MACHINE OF CHAIR TYPE

(75) Inventors: Kazushi Kamba, Sanda (JP); Toshihiro Matsumoto, Nishiwaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 262 days.

(21) Appl. No.: 11/881,898

(22) Filed: Jul. 30, 2007

(65) Prior Publication Data

US 2008/0030053 A1 Feb. 7, 2008

(30) Foreign Application Priority Data

Aug. 1, 2006 (JP) ..... 2006-209539

(51) Int. Cl.
*A61H 7/00* (2006.01)

(52) U.S. Cl. ..... 601/98; 297/217.3; 297/85 M; 297/68

(58) Field of Classification Search ..... 297/217.1, 297/217.3, 411.42, 85 M, 68; 601/98, 49, 601/149, 151; 4/517, 519, 523
See application file for complete search history.

(56) References Cited

U.S. PATENT DOCUMENTS 3,736,920 A * 6/1973 Mathers et al. ..... 601/52
5,230,113 A 7/1993 Foster et al.
5,421,360 A * 6/1995 Castaneda et al. ..... 137/192
5,813,727 A * 9/1998 Sugawa et al. ..... 297/411.42
6,154,690 A * 11/2000 Coleman ..... 701/1
6,190,338 B1 * 2/2001 Arndt ..... 601/115
6,290,661 B1 * 9/2001 Cutler et al. ..... 601/49
6,494,850 B1 * 12/2002 Kitadou et al. ..... 601/49
6,503,212 B2 * 1/2003 Park ..... 601/158
6,695,799 B2 * 2/2004 Kitadou et al. ..... 601/49
6,832,991 B1 * 12/2004 Inada et al. ..... 601/99
6,974,186 B1 12/2005 Chang
6,976,699 B2 * 12/2005 Koerlin ..... 280/650

(Continued)

FOREIGN PATENT DOCUMENTS

DE 199 26 011 12/2000

(Continued)

*Primary Examiner*—David Dunn
*Assistant Examiner*—Erika Garrett
(74) *Attorney, Agent, or Firm*—Eckert Seamans Cherin & Mellott, LLC; Kirk D. Houser, Esquire

(57) ABSTRACT

A chair-type massage machine is provided which comprises a seat, backrest and leg portion having a plurality of preset reclining angles for giving an effective massage to the user in various postures. The massage machine comprises a seat pivotally movably supported by a base, a backrest pivotally movably supported by the seat at the rear end thereof, a leg portion pivotally movably supported by the seat at the front end thereof, control means for controlling seat moving means, backrest moving means and the leg portion moving means and a manual controller. The control means has stored therein a plurality of preset reclining angles with respect to the angle of the seat, backrest and the leg portion. The manual controller has reclining selection buttons for selecting one of the reclining angles and an initial position button. The control means operates the moving means for the seat, backrest and leg portion when the reclining angle is selected by the reclining selection button and pivotally moves the seat, backrest and leg portion to the selected angle.

11 Claims, 11 Drawing Sheets

U.S. PATENT DOCUMENTS

| | | | | |
|---|---|---|---|---|
| 7,159,181 | B2 * | 1/2007 | Mansell et al. | 715/744 |
| 7,239,096 | B2 * | 7/2007 | Hancock et al. | 318/59 |
| 2001/0041852 | A1 * | 11/2001 | Park | 601/157 |
| 2004/0158181 | A1 * | 8/2004 | Watanabe et al. | 601/99 |
| 2005/0088028 | A1 | 4/2005 | Wan et al. | |
| 2006/0142676 | A1 * | 6/2006 | Fujii et al. | 601/98 |

FOREIGN PATENT DOCUMENTS

| | | | |
|---|---|---|---|
| JP | 2000254188 | * | 9/2000 |
| JP | A-2004-344316 | | 12/2004 |
| JP | 2005185466 | * | 7/2005 |
| JP | 2006034840 | * | 2/2006 |
| WO | WO 01/82751 | | 11/2001 |

* cited by examiner

MASSAGE MACHINE OF CHAIR TYPE

TECHNICAL FIELD

The present invention relates to massage machines of the chair type comprising a seat, backrest and leg portion which are pivotally movable.

BACKGROUND ART

Chair-type massage machines comprise a seat, backrest and leg portion which are each pivotally movable. The seat, backrest and leg portion each have incorporated therein massage means for massaging the affected part of the user to be treated.

The massage machine has moving means adapted to pivotally moving the seat, backrest and leg portion, respectively. The machine has a manual control unit, which is manipulated by the user for pivotally moving the seat, backrest and leg portion to a desired angle, or automatically pivotally moving the seat, backrest and leg portion to a preset reclining angle (see, for example, JP2004-344316A).

However, the preset reclining angle is solely one value. No massage machines are available which are adapted to present a plurality of reclining angles, nor are there any massage machines which have a plurality of preset reclining angles enabling the user to feel apparently different when seated in the seat as set at the different angles.

An object of the present invention is to provide a massage machine of the chair type comprising a seat, backrest and leg portion having a plurality of preset reclining angles for giving an effective massage to the user in various postures.

SUMMARY OF THE INVENTION

To fulfill the above object, the present invention provides a massage machine of the chair type which comprises a base to be placed on a floor, a seat pivotally movably supported by the base for the user to be seated in, a backrest pivotally movably supported by the seat at a rear end thereof for the user's back to bear on, a leg portion pivotally movably supported by the seat at a front end thereof for the user's calves to bear on, seat moving means for pivotally moving the seat, backrest moving means for pivotally moving the backrest, leg portion moving means for pivotally moving the leg portion, control means for controlling the seat moving means, the backrest moving means and the leg portion moving means, a manual controller electrically connected to the control means for manipulating the seat moving means, the backrest moving means and the leg portion moving means, the control means having stored therein a plurality of preset reclining angles with respect to the angle of the seat, backrest and the leg portion, the manual controller having reclining selection buttons for selecting desired one of the plurality of reclining angles, the control means being operable to operate the seat moving means, the backrest moving means and the leg portion moving means when the reclining angle is selected by the reclining selection button and pivotally move the seat, the backrest and the leg portion to the selected reclining angle.

The chair-type massage machine of the invention has a plurality of preset reclining angles for the seat, the backrest and the leg portion, and the seat, backrest and leg portion can be pivotally moved to the desired reclining angle by the manipulation of the user for the user to receive a massage on the affected part in an optimum posture to achieve an enhanced massage effect.

DESCRIPTION OF THE PREFERRED EMBODIMENT

Figure 1:
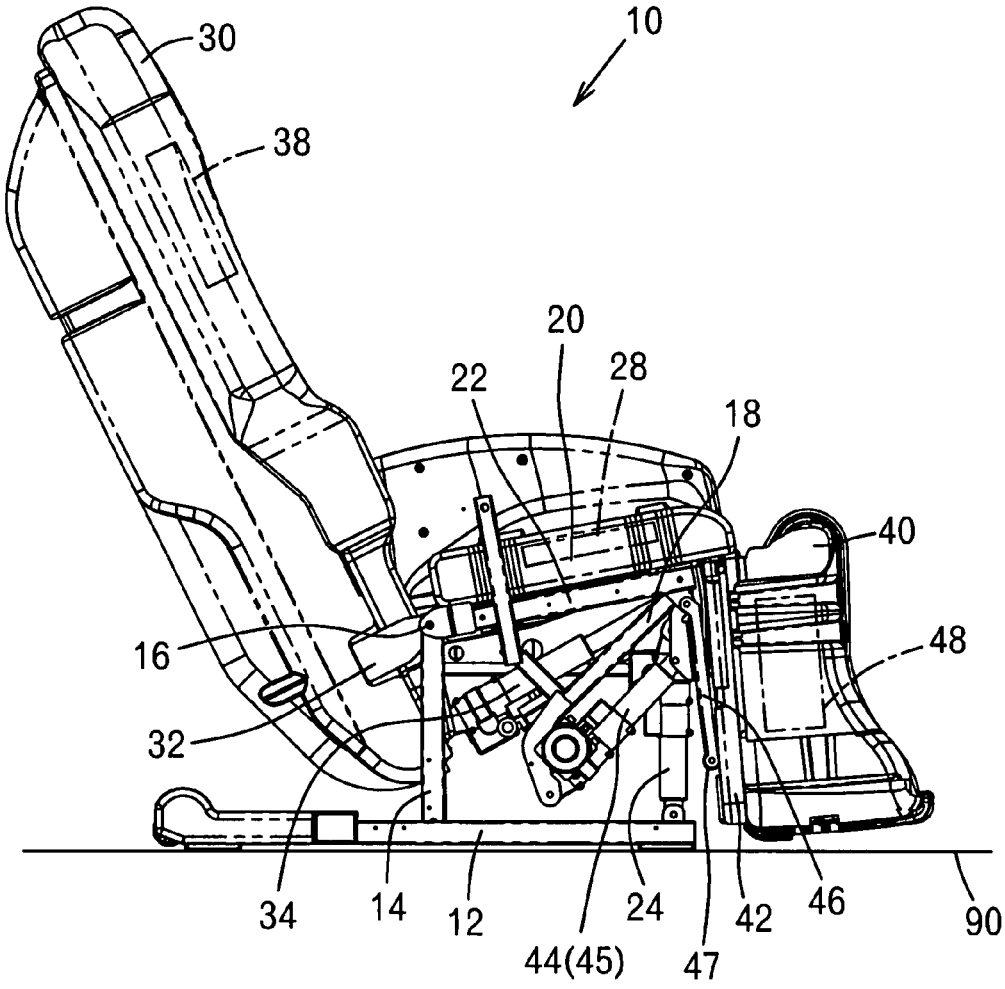
FIG. 1 is a side elevation of a chair-type massage machine (in a home position) of the invention.

FIG. 1 is a view showing a massage machine 10 of the chair type as it is seen from one side thereof. For a better understanding, the machine is shown with an armrest thereof closer to the viewer removed.

As illustrated, the chair-type massage machine 10 has a base 12 to be placed on a floor 90 and a seat 20 provided on the base 12 for the user to sit in. The seat 20 is provided with a backrest 30 at the rear end thereof and with a leg portion 40 at the front end thereof.

The seat 20 has a seat frame 22 provided with a cushion or the like and pivotably supported at its rear end by a base frame 14. The seat frame 22 has a front end connected to seat moving means 24 comprising a motor or an actuator serving as drive means. The illustrated embodiment has a motor serving as the drive means. The seat 20 is pivotally movable relative to the base 12 by operating the seat moving means 24.

An air bag or like massage means 28 is provided on the seat 20.

The backrest 30 is pivotally movable relative to the seat 20 or the base 12 by backrest moving means 34 comprising a motor or actuator as drive means. The drive means of the illustrated embodiment is a motor.

According to the illustrated embodiment, a backrest frame 32 is pivoted to the base 12 by a pivot 16 which serves also for the seat frame 22 in common. The backrest moving means 34 has one end connected to the lower end of the backrest frame 32 and the other end connected to the front end of the seat frame 22. Accordingly, when the seat 20 is pivotally moved, the backrest 30 pivotally moves with the seat 20. To pivotally move the seat 20 only without pivotally moving the backrest 30, it is therefore necessary to pivotally move the backrest 30 in a direction opposite to the direction of pivotal movement of the seat 20.

It is also possible to pivotally movably support the backrest 30 on the base 12 and to connect the other end of the backrest moving means 34 also to the base 12. The backrest 30 is then pivotally movable independently of the seat 20. The backrest 30 is pivotally movable with the seat 20 by pivotally moving the backrest 30 in the same direction as the direction of pivotal movement of the seat 20.

The backrest 30 is provided with therapeutic fingers or like known massage means 38 upwardly or downwardly movably.

The leg portion 40 is supported directly by the forward end of the seat 20. The leg portion 40 is provided with air bags or like massage means 48.

Leg portion moving means 44 for pivotally moving the leg portion 40 may comprise a motor, actuator or like drive means which is provided on the seat 20. Alternatively, the leg portion 40 may be pivoted to the seat 20, and the drive means providing the leg portion moving means 44 may be provided on the base 12 to prevent the seat 20 from becoming heavier.

According to the illustrated embodiment, a motor serves as the drive means providing the leg portion moving means 44. A frame 18 extending rearward from the bottom of the front end of the seat 20 has supported thereon an actuator 45 which is pivotally movable in a plane parallel to the front-to-rear direction. The actuator 45 has a forward end which is connected to a pushing-up frame 46 pivoted to the bottom of a front portion of the seat 20. The pushing-up frame 46 carries at its forward end a roller 47. The leg portion 40 has a frame 42 which is adapted to come into contact with the roller 47.

When the actuator 45 providing the leg portion moving means 44 is operated in a stretching direction, the pushing-up frame 45 pivotally moves to a forwardly raised position to push the leg portion 40 forwardly upward. When the actuator 45 is operated toward a retracting direction, the pushing-up frame 46 retracts to move the leg portion 40 downward. The leg portion frame 42 is merely in bearing contact with the roller 47 under gravity, so that when an article or like obstacle is present in the path of movement of the leg portion 40, the roller 47 moves out of contact with the leg portion frame 42, obviating the likelihood that the leg portion 40 will retract further.

Figure 5:
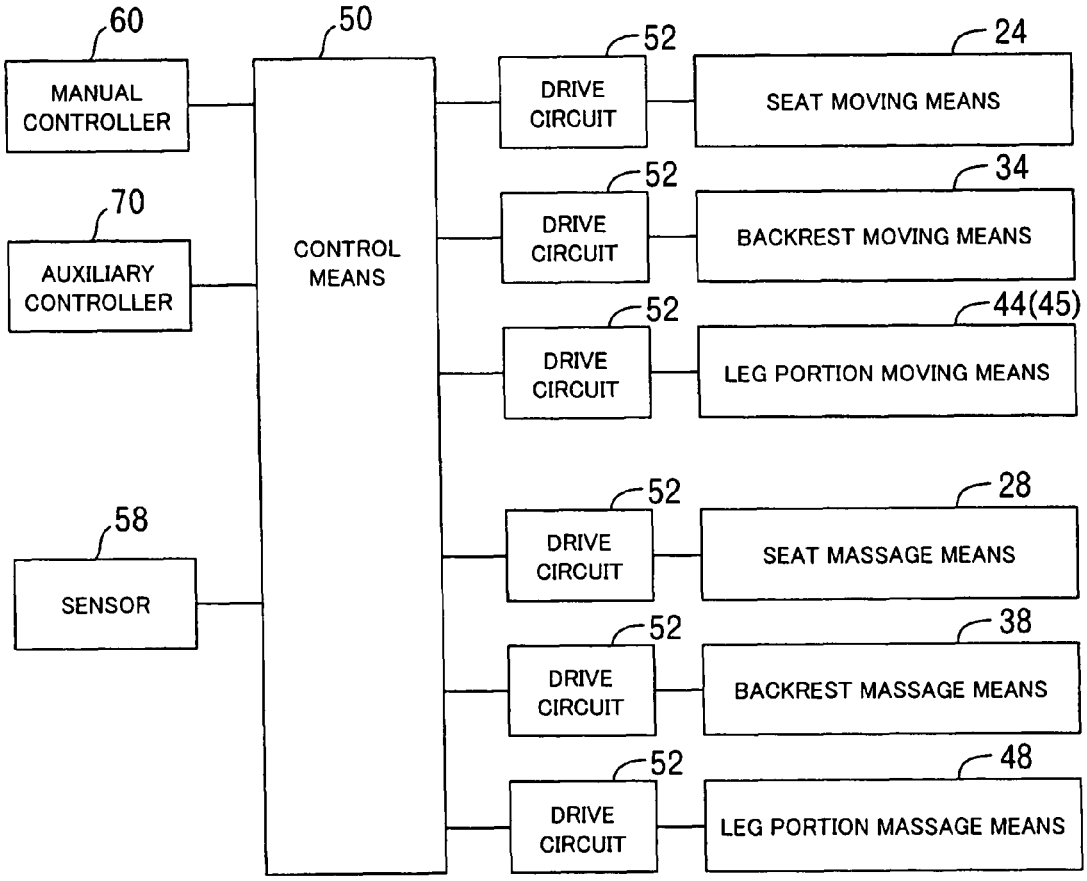
FIG. 5 is a block diagram of control means.

The moving means 24, 34, 44 and the massage means 28, 38, 48 are electrically connected by drive circuits 52, 52, 52 to control means 50 disposed at a suitable portion of the massage machine 10 to operate in response to commands from the control means 50. The control means 50 comprises a CPU, control circuits, memories, etc. for the moving means 24, 34, 44 as seen in FIG. 5.

Figure 6:
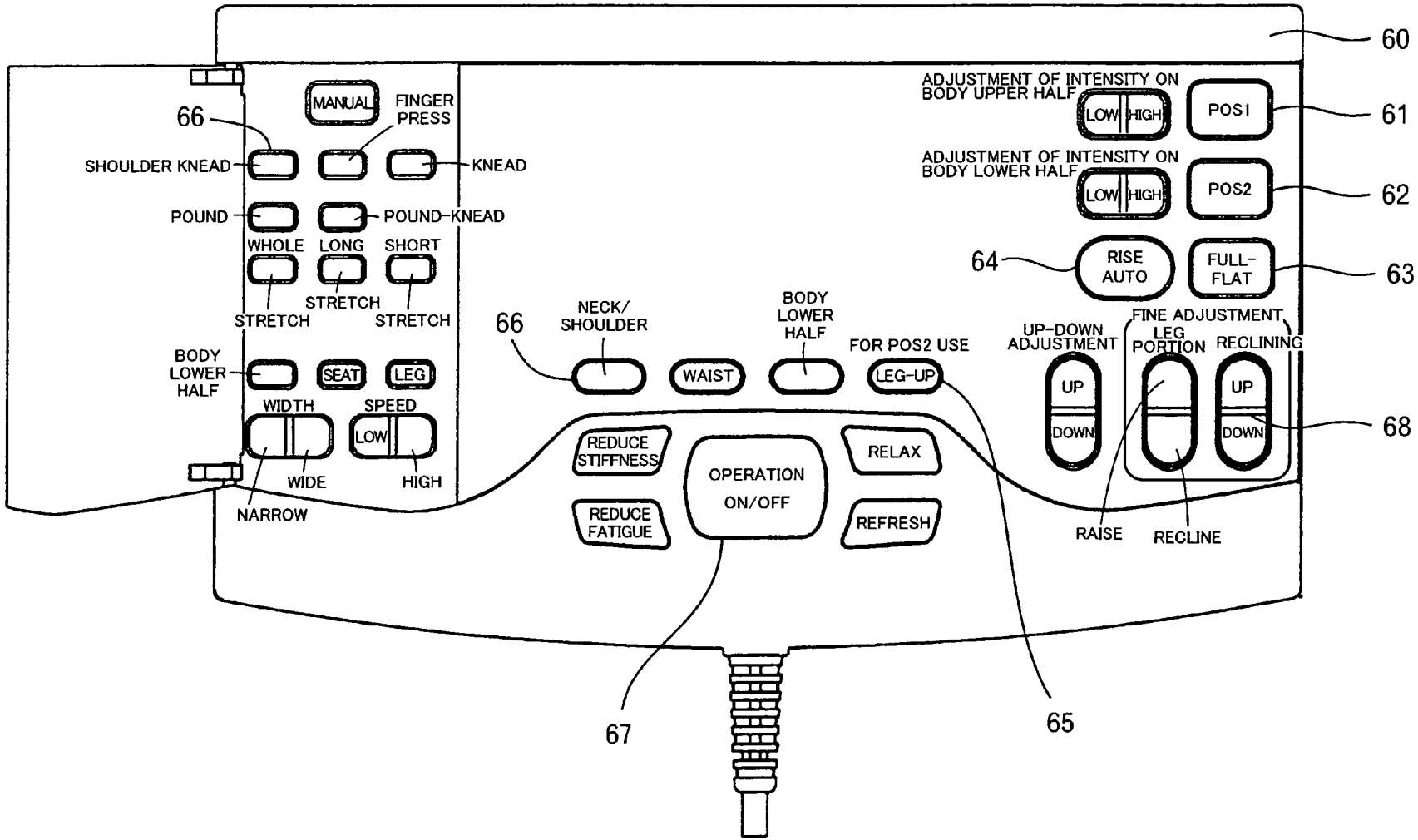
FIG. 6 is a plan view of a manual controller.

FIG. 6 shows a manual controller 60 for manipulating the massage machine 10 variously. The manual controller 60 is electrically connected to the control means 50, and has a plurality of buttons 61 to 68 for effecting various modes of control of the massage means 28, 38, 48 and suitably adjusting moving angles (reclining angles) of the seat 20, backrest 30 and leg portion 40. No description will be given of the method of manipulating the massage means 28, 38, 48 and the kinds of movements thereof.

The reclining selection buttons 61, 62, 63 on the manual controller 60 serve to operate the respective moving means 24, 34, 44 so as to pivotally move the seat 20, backrest 30 and leg portion 40 to "preset reclining angles" stored in the memory of the control means 50 for the respective buttons.

The manual button 64 is an initial position button for restoring the reclining angle to a preset "initial angle (home position)."

At the touch of the reclining selection button 61, 62 or 63 or the initial position button 64, the control means 50 operates the moving means 24, 34 or 44 to pivotally move the seat 20, backrest 30 or leg portion 40 to the preset angle. The angle of the seat 20, backrest 30 or leg portion 40 can be detected, for example, by a limit switch or encoder.

Figure 7:
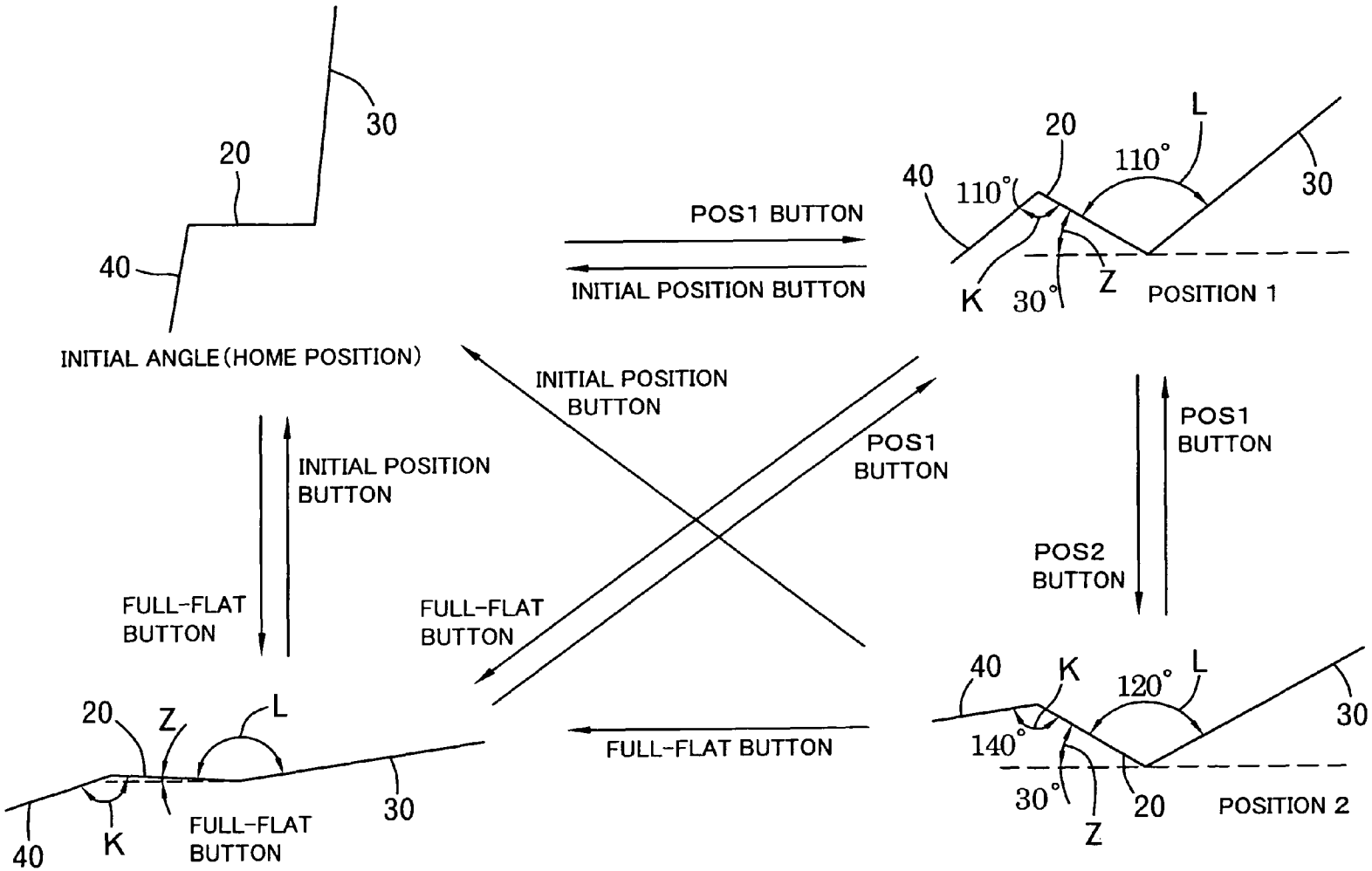
FIG. 7 is a diagram showing changes in the state of a seat, backrest and leg portion of the chair-type massage machine of the invention.

With reference to FIG. 1 and the "home position" in FIG. 7, the initial angle can be such that the seat 20 is substantially horizontal with respect to the floor, with the backrest 30 and leg portion 40 positioned approximately perpendicular to the seat 20. The memory of the control means 50 has stored therein the initial angle in advance. The initial angle is an angle enabling the user to sit in the seat easily or to stand up therefrom easily. For example, the seat 20 or the like can be returned to the initial angle by a touch of the initial position button 64.

Figure 2:
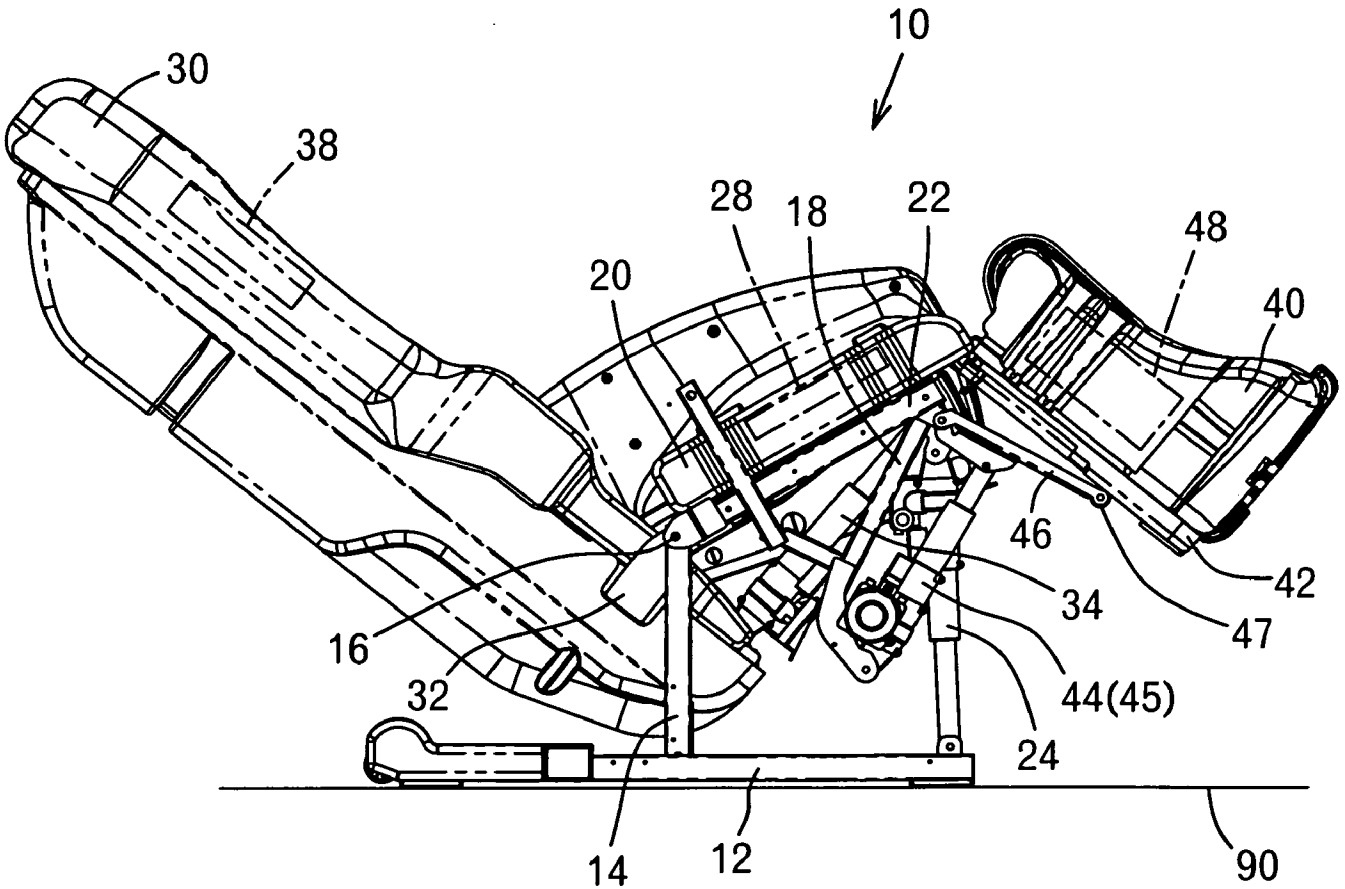
FIG. 2 is a side elevation of the chair-type massage machine (in position 1) of the invention.

With reference to FIG. 7, "position 1 (POS1)," the preset reclining angle can be, for example, such that the seat 20 makes with the floor 90 an angle Z of 20 to 40 degrees, preferably about 30 degrees, makes with the backrest 30 an angle L of 100 to 120 degrees, preferably about 110 degrees, and makes with the leg portion 40 an angle K of 100 to 120 degrees, preferably about 110 degrees (see FIG. 2). With reference to FIG. 7 showing these angles Z, L and K, the angle Z causes the seat 20 to be positioned at a higher level above the floor toward its front end, the angle L is an angle the seat 20 makes with the backrest 30 on their upper surfaces, and the angle K is an angle the seat 20 makes with the leg portion 40 on their lower surfaces. In position 1, the user as seated feels least burdened on the muscles, feeling relaxed and at ease throughout his or her whole body. The muscles are relaxed on the front and rear sides of the body, and the massage means 28, 38, 48 are operated in this state, whereby the user can be massaged effectively. The seat 20 and other portions are moved to position 1 at the touch of the reclining selection button 61 (POS1).

Figure 3:
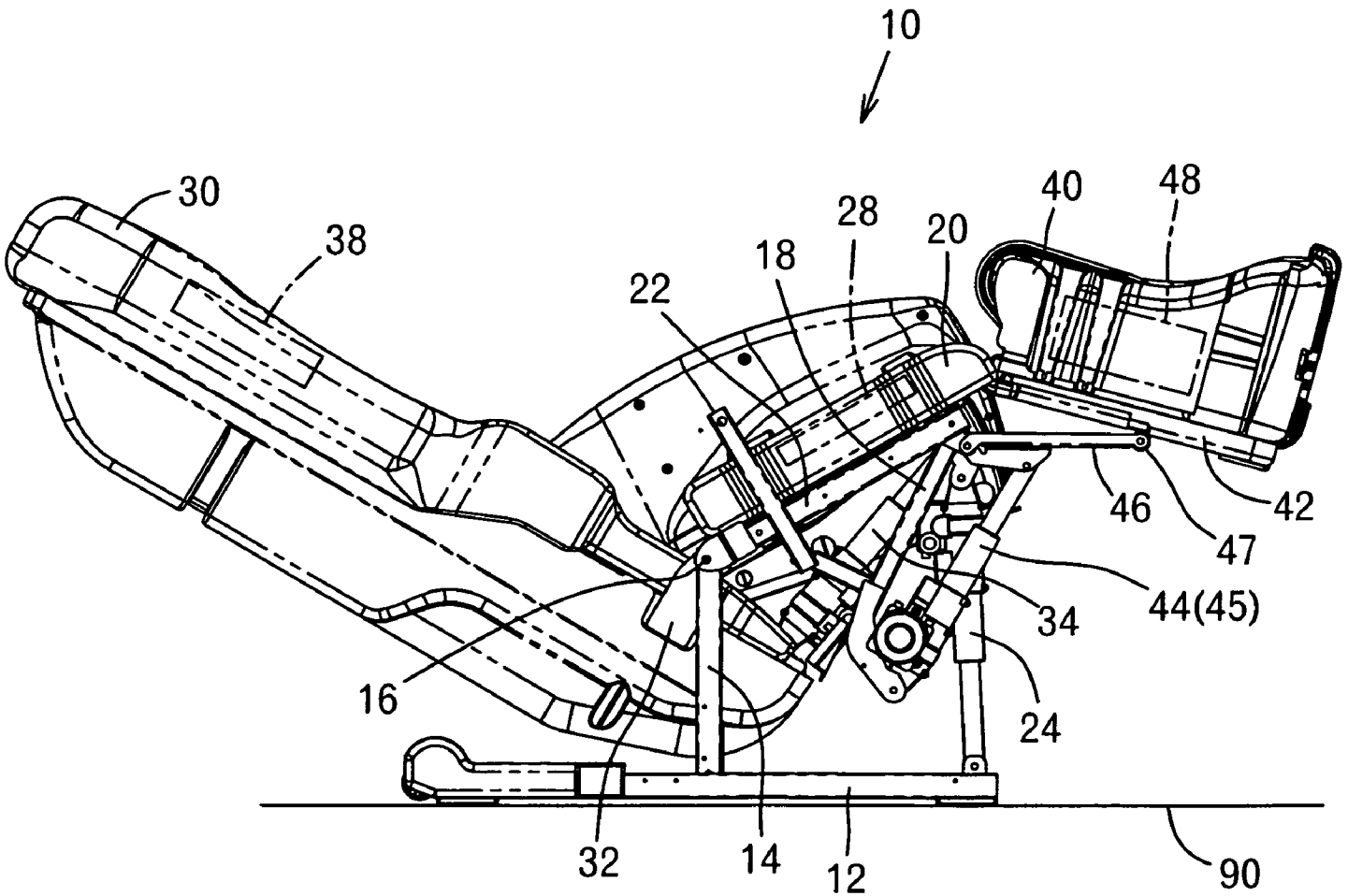
FIG. 3 is a side elevation of the chair-type massage machine (in position 2) of the invention.
Figure 4:
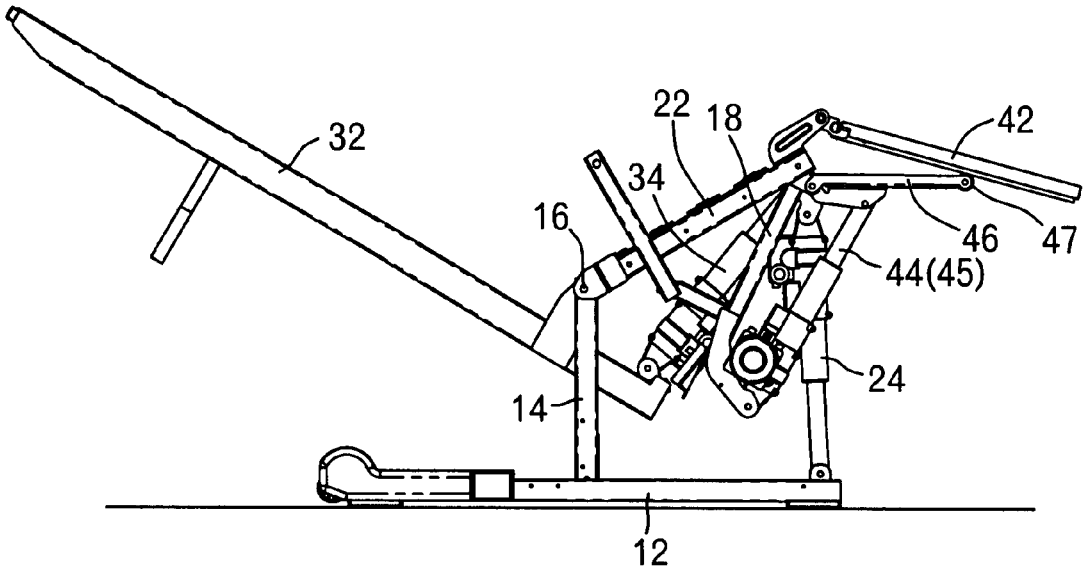
FIG. 4 is a view showing only frames and the like serving as main components of the massage machine of FIG. 3.

With reference to FIG. 7, "position 2 (POS2)," a different example of reclining angle can be such that the seat 20 makes with the floor 90 an angle Z of 20 to 40 degrees, preferably about 30 degrees, makes with the backrest 30 an angle L of 110 to 130 degrees, preferably about 120 degrees, and makes with the leg portion 40 an angle K of 130 to 160 degrees, preferably about 140 degrees (see FIGS. 3 and 4).

Figure 8:
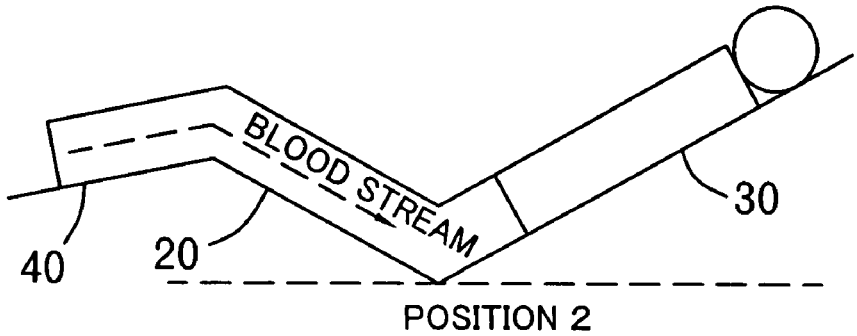
FIG. 8 is a diagram showing the posture of the user in position 2.

As shown in FIG. 8, position 2 makes it possible to give a massage to the user in a more gentle posture than position 1. The feet are at a higher level in position 2 than in position 1, so that the massage means 28, 38, 48, when operated in this state, give an effective massage especially to the legs to relieve the legs of fatigue. The seat 20 and the other portions can be moved to position 2 at the touch of the reclining selection button 62 (POS2).

The feet can be positioned at a higher level in position 2 and thereby brought to a higher level than the heart to position the knees at a lower level than the heart and thereby ensure an improved blood flow through the legs.

Since the legs of the user are raised to a higher level in position 2 than in position 1, it is desirable to move the leg portion to this position from the initial position by way of position 1 instead of moving the leg portion directly from the initial position so as to lessen the burden on the user.

The legs of the user can be effectively massaged by giving a massage by the massage means 48 on the leg portion 40 after pivotally moving the seat 20, etc. to position 2, utilizing the advantage that the posture of the user in position 2 is favorable for the effective blood flow through the legs. In this case, it is desirable to provide, for example, a leg-up button (leg-raising body lower half button) 65 on the manual controller 60 for operating the massage means 48 as shown in FIG. 6, and to make the button 65 pushable only when the massage machine 10 is in position 2. Alternatively, the machine may be made automatically movable to position at the touch of the button 65.

Massaging the legs concentrically with the legs held at a higher level not only improves the blood stream through the legs but also results in the advantage of improving the blood flow through the whole body.

Further as indicated by "full-flat" in FIG. 7, another example of preset different reclining angle is an angle positioning the backrest 30 and the leg portion 40 substantially horizontally with respect to the floor 90 and positioning the seat 20, backrest 30 and leg portion 40 substantially flat. The seat 20, etc. can be moved to a full-flat position at the touch of the reclining button 63 (full-flat). The full-flat position provides a flat chair like a bed, enabling the user to lie down so as to be given a massage in a relaxed state.

Although the machine is movable into position 1, position 2 or full-flat position by pushing the corresponding reclining selection button 61, 62 or 63, it is alternatively possible to effect a change-over between position 1, position 2 and full-flat position every time a single reclining selection button is pushed. When the reclining selection button is pushed within a predetermined period of time, e.g., within 2 seconds, after the depression of the button in this case, the touch of the button is accepted for a change-over without permitting any movement for the period of 2 seconds.

When the seat 20, backrest 30 and leg portion 40 are to be returned to the initial angle after having been pivotally moved to position 1, position 2 or the other position, the moving means 24, 34, 44 may be operated regardless of the angle of pivotal movement of the seat 20, backrest 30 and leg portion 40. The user will then be brought to an unnatural posture to feel discomfort.

It is therefore desirable to detect the position relationship between the seat 20 and the leg portion 40 and to make such adjustment as not to permit the leg portion 40 to return to the initial angle prior to the seat 20. For example, it is desirable to return the leg portion 40 to its initial angle after causing the seat 20 to restore its initial angle.

If the leg portion 40 is at the initial angle with the seat 20 or nearly at this angle therewith, it may be useful to pivotally move the leg portion 40 temporarily in a direction opposite to the correct direction of movement (namely. to raise the leg portion 40) and to thereafter pivotally move the leg portion 40 toward the initial angle while pivotally moving the seat 20 toward the initial angle.

Figure 9:
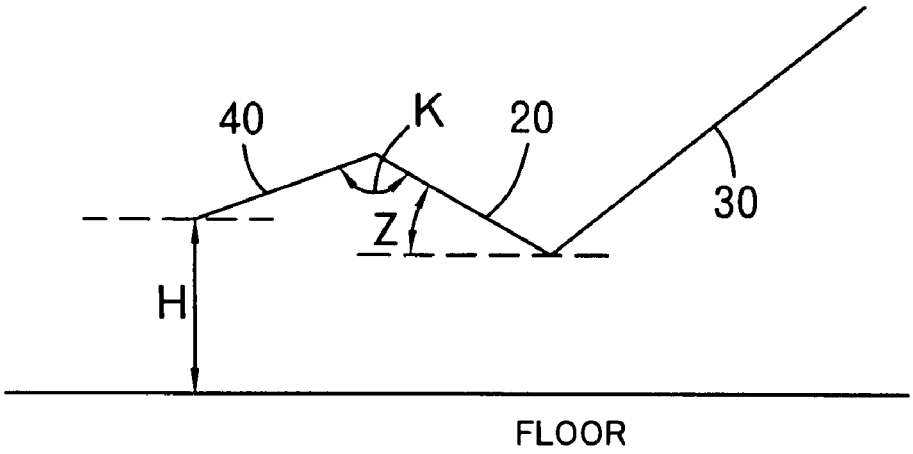
FIG. 9 is a diagram for illustrating the angle Z of the seat with respect to the floor, the angle K of the leg portion with respect to the seat, and the level H of the leg portion.

Further alternatively, the timing for the leg portion 40 to restore its initial angle may be altered based on the angle Z the seat 20 makes with the floor 90 and the angle K the leg portion 40 makes with the seat 20 as shown in FIG. 9.

Stated more specifically, a touch of the initial position button 64 operates the moving means 24, 34, 44 for the seat 20, backrest 30 and leg portion 40, causing these portions 20, 30, 40 to restore their initial angles.

Figure 10:
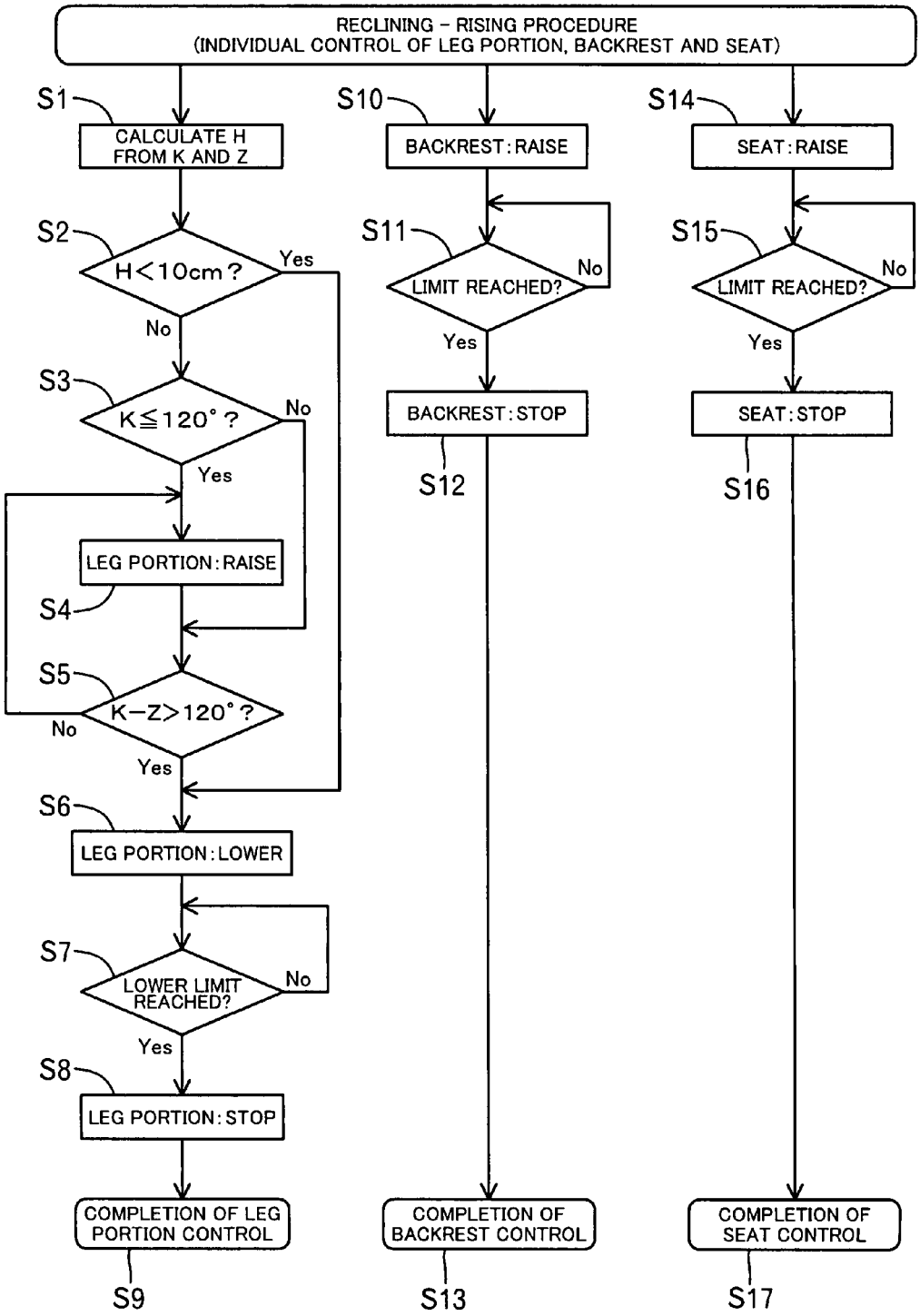
FIG. 10 is a flow chart showing an example of reclining control procedure of the chair-type massage machine of the invention.

As shown in the flow chart of FIG. 10, the moving means 24, 34 of the seat 20 and the backrest 30 come to a stop at this time after operating to cause the seat 20 and the backrest 30 to restore their initial angles (steps 10 to 13 and steps 14 to 17).

For the leg portion 40, on the other hand, the moving means 44 is operated based on the level of the leg portion 40, the angle the portion 40 makes with the seat 20 and the angle between the floor 90 and the seat 20 as illustrated in the flow chart of FIG. 10.

With reference to the flow chart of FIG. 10, the control means 50 first calculates the level H of the outer end of the leg portion 40 from the floor 90 (see FIG. 9) based on the angle Z of the seat 20 and the angle K of the leg portion 40 (step 1). If the calculated level H is smaller than, for example, 10 cm (step 2), some article is unlikely to become caught between the leg portion 40 and the floor 90, so that the moving means 44 is operated so as to lower the leg portion 40 as it is (step 6). When the initial angle is reached (step 7), the moving means 44 is halted (step 8) to complete the movement (step 9).

On the other hand, if the level H of the leg portion 40 is not smaller than 10 cm (step 2) and when the angle K of the leg portion 40 (see FIG. 9) is, for example, up to 120 degrees (step 3), that is, when the angle between the leg portion 40 and the seat 20 is small, the moving means 44 of the leg portion 40 is operated once in a direction opposite to the direction toward the initial angle to pivotally move the leg portion so as to increase the angle K between the leg portion 40 and the seat 20 (step 4).

In the case where the angle K of the leg portion 40 is found to be greater than 120 degrees in step 3, or after the angle K between the leg portion 40 and the seat 20 has been increased by operating the moving means 44 in step 4, the difference between the angle K and the angle Z is calculated, and the operation of the moving means 44 is continued until the difference exceeds, for example, 120 degrees (step 5).

Upon the difference between the angle K and the angle Z exceeding 120 degrees Z (step 5), the moving means 44 is operated so as to lower than leg portion 40 (step 6). When the initial angle is reached (step 7), the moving means 44 is halted (step 8) to complete the operation (step 9).

As described with reference to the flow chart, the timing for the leg portion 40 to restore the initial angle is altered, for example, base on the angle of pivotal movement of the leg portion 40 with respect to the floor. This obviates the likelihood that the leg portion 40 as positioned at a high level will restore the initial angle earlier than the seat 20, consequently precluding an article from becoming caught between the leg portion 40 and the floor 90.

The embodiment described above is adapted to alter the timing for the leg portion 40 to restore its initial angle, based on the angle K the leg portion 40 makes with the seat 20 and the level H of the outer end of the leg portion 40, whereas the restoration timing may be altered base on one of these two values.

In the case where the backrest 30 is reclined by the reclining selection buttons 61 to 63, it is desirable that the speed of pivotal movement of the backrest 30 be smaller in the reclining direction than in the raising direction.

If the speed of the backrest 30 is greater in the reclining direction, the user who falls down rearward will be frightened. It is therefore desired that the speed of the backrest 30 be smaller in the reclining direction. However, when the backrest 30 is pivotally moved toward the raising direction, the user will be raised while facing toward the front and will therefore feel no fear. If the user wishes to stand up quickly from the backrest 30 as reclined and when the speed of the backrest 30 is small in the raising direction, the user will feel irritated or annoyed.

Accordingly, the backrest 30 is so controlled as to be reclined at a lower speed than when it is raised. The raising and reclining speeds of the backrest 30 are adjustable by varying the rotational speed of the motor of the moving means 34 for the backrest 30.

By making the reclining speed of the backrest 30 smaller than the speed of rise of the seat 20 (movement toward the horizontal direction), it is possible to prevent the backrest 30 from coming into contact with the floor or the limit switch from chattering, for example, when the backrest 30 is reclined (for example, to the full-flat position) while raising the seat 20 from the most reclined state.

This will be described in detail. If the backrest 30 is reclined at a high speed, for example, from position 1 or position 2 in FIG. 7 to the full-flat position, the backrest 30 will reach the floor before the seat 20 is brought to an approximately horizontal position. Accordingly, the limit switch is actuated to discontinue the reclining movement of the backrest 30 before this portion 30 reaches the floor. The seat 20 continues pivotally moving toward the rising direction while the backrest 30 is held at rest from the reclining movement. With this movement of the seat 20, the backrest 30 rises again to release the limit switch. The release of the limit switch causes the moving means 34 to drive the backrest 30 toward the reclining direction again, permitting the chattering of the limit switch again for repeated chattering. However, such an incidence is avoidable by giving a lower reclining speed to the backrest 30. The backrest 30 can be prevented from reaching the floor in the absence of the limit switch.

Further if the backrest 30 is given a high moving speed for reclining, the user is likely to become frightened, whereas the user can realize the reclining movement of the backrest 30 in advance in the case where the backrest 30 is reclined by the manual procedure of pushing the reclining button 68. When the manual procedure is used, therefore, the backrest 30 may be reclined rearward at a higher speed than the movement, for example, to position 1 or position 2.

Figure 11:
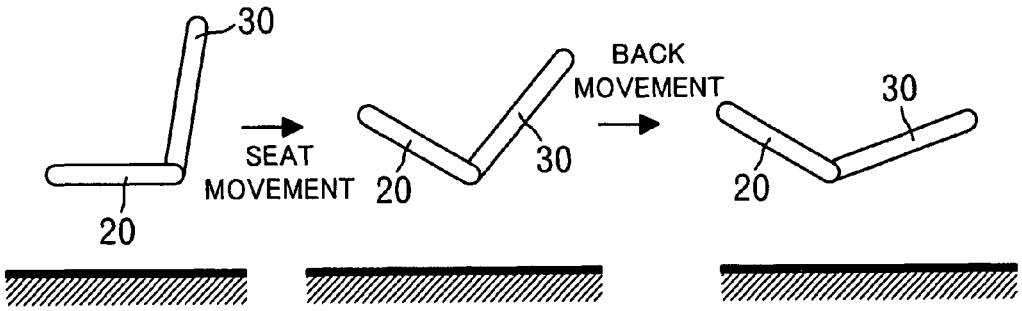
FIG. 11 is a diagram showing the seat as pivotally moved earlier than the backrest.
Figure 12:
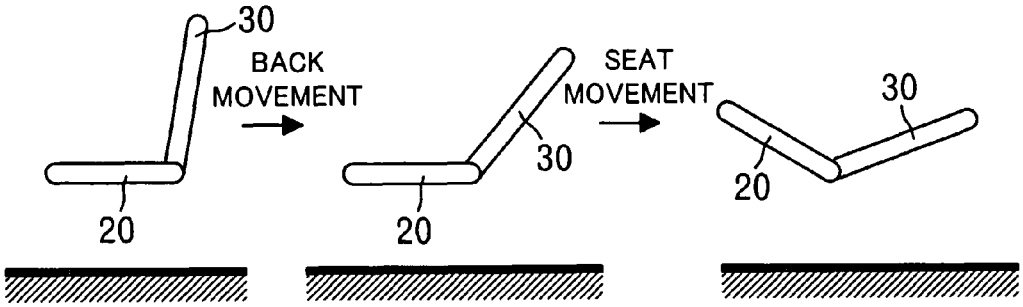
FIG. 12 is a diagram showing the backrest as pivotally moved earlier than the seat.

The embodiment shown in FIGS. 1 to 4 is so adapted that the backrest 30 is pivotally movable with the seat 20 when the seat 20 is pivotally moved. When the moving means 24 of the seat 20 and the moving means 34 of the backrest 30 are operated at the same time in this case, the speed of the backrest 30 relative to the floor is "the speed of the seat relative to the floor"+"the speed of the backrest relative to the floor," hence an increased speed that will frighten the user when the backrest 30 is reclined. The user will further feel discomfort when the backrest 30 rises. Accordingly, to calm the fear to be felt by the user when the backrest 30 falls down, it appears desirable to follow the procedure to be described below when the seat 20 and the backrest 30 are to be pivotally moved to position 1, position 2 or full-flat position, or when the seat 20 and the backrest 30 are to be pivotally moved to the position of initial angle (home position). Thus, instead of operating the moving means 24, 34 for the seat 20 and backrest 30 at the same time, it is desirable to operate the moving means 24 of the seat 20 first to move the seat 20 to the desired angle and to subsequently operate the moving means 34 of the backrest 30 to move the backrest 30 to the desired angle as shown in FIG. 11. Conversely, it may be advisable to operate the moving means 34 of the backrest 30 first to move the backrest 30 to the desired angle and to subsequently operate the moving means 24 of the seat 20 to move the seat 20 to the desired angle as shown in FIG. 12.

Thus, the user is unlikely to become frightened or uncomfortable, with his or her body prevented from reclining rearward or inclining forward rapidly in its entirety.

With the moving means 24, 34 prevented from being operated at the same time in this way, another advantage is available in that the momentary power consumption by the moving means 24, 34 can be diminished.

While the moving means 24, 34 or 44 is held in operation by pushing one of the reclining selection buttons 61, 62, 63 for movement to position 1, position 2 and full-flat position and the initial position button 64 for movement to the home position, it is likely that one of these buttons 61, 62, 63, 64, the other reclining-related button (e.g., manual reclining button 68) and manual buttons will be manipulated. It is then desirable to halt the operation of the moving means 24, 34, 44 of the seat 20, backrest 30 and leg portion 40. Thus, enhanced safety can be assured by bringing the moving means 24, 34, 44 out of operation when one of the buttons is pushed while the moving means 24, 34, 44 is in operation.

Furthermore, it is desirable that a sensor 58 (see FIG. 5) electrically connected to the control means 50 for detecting the presence or absence of the person to be massaged be provided for the backrest 30 and/or the seat 20, so as to check the massage machine 10 for the presence or absence of the person thereon. When no person is detected for a massage, it is desirable that the moving means 24, 34, 44 be so controlled as to be held out of operation even if any one of the reclining selection buttons 61, 62, 63, initial position button 64, etc. is manipulated.

The sensor 58 to be used is, for example, a pressure sensor or a switch comprising an electrode.

Operation errors can be prevented to ensure enhanced safety by limiting the operation of the moving means 24, 34, 44 depending on whether the person to be treated is present or not.

When the initial position button 64 for moving the seat 20, backrest 30 and leg portion 40 to the home position is pushed while the user is being treated by the massage means 28, 38, 48, it is desirable to halt the operation of the massage means 28, 38, 48 and to thereafter operate the moving means 24, 34, 44 by the control operation of the control means 50.

The user pushes the initial position button 64 usually when desiring to terminate the massage operation. Accordingly, the massage operation can be terminated without discomfort by bringing the massage means 28, 38, 48 out of operation before the seat 20, backrest 30 and leg portion 40 are moved to the home position. This enables the user to stand up smoothly upon the seat 20, etc. reaching the home position.

FIG. 6 shows an operation on/off switch 67. The manual controller is so adapted that when this switch is off, the manual buttons such as the reclining selection buttons 61 to 63 and manual reclining button 68 are held inoperative, except for the initial position button 64 which alone is operative for the return of the movable components to the home position. This assures convenience.

Figure 13:
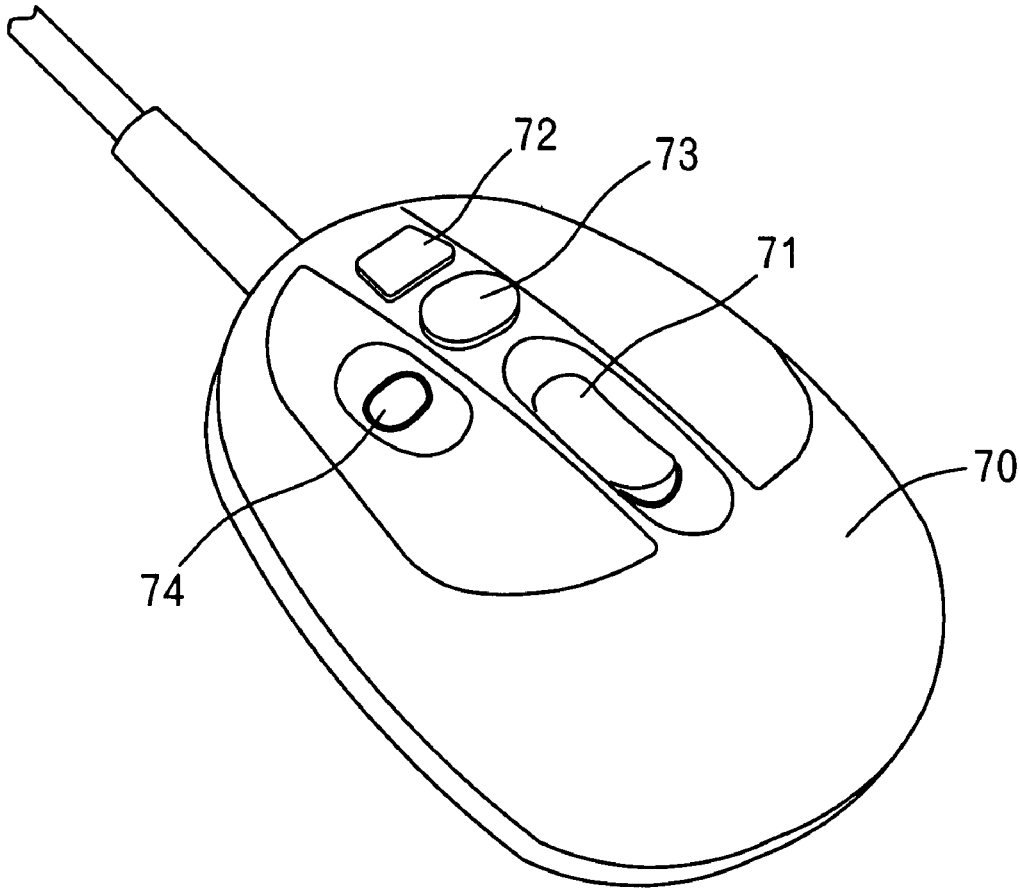
FIG. 13 is a perspective view of an auxiliary controller.

While the manual controller 60 has many buttons 61 to 68, etc. as shown in FIG. 6, the controller is preferably provided with an auxiliary controller 70 of different size as shown in FIG. 13. The auxiliary controller 70 is electrically connected to the control means 50 and, for example, can be provided with only a manual button 71 for moving the seat 20, backrest 30 and leg portion 40 to position 1 which is frequently used, massage start button 72, stop button 73 and initial position button 74 for restoring the seat 20, backrest 30 and leg portion 40 to the initial angle (home position).

The auxiliary controller 70 of small size for a minimized number of manipulations enables the user to select a desired manipulation by groping during a massage operation without causing any trouble to the massage operation.

INDUSTRIAL APPLICABILITY

The invention provides a massage machine of the chair type comprising a seat, backrest and leg portion having a plurality of preset reclining angles for giving an effective massage to the user.

What is claimed is:

1. A chair-type massage machine comprising:

(a) a base to be placed on a floor, (b) a seat pivotally movably supported by the base for a user to be seated in, (c) a backrest pivotally movably supported by the seat at a rear end thereof for the user's back to bear on, (d) a leg portion pivotally movably supported by the seat at a front end thereof for the user's calves to bear on, (e) seat moving means for pivotally moving the seat, (f) backrest moving means for pivotally moving the backrest, (g) leg portion moving means for pivotally moving the leg portion, (h) a manual controller controllable by the user, (i) reclining selection buttons provided on the manual controller, and (j) control means electrically connected to the manual controller and structured to control the seat moving means, the backrest moving means and the leg portion moving means, said control means being preprogrammed to take a plurality of sets of preset reclining angles Z, L and K with respect to the angle of the seat, the backrest and the leg portion, respectively, wherein said reclining angle Z is an angle to bring the seat to 20 to 40 degrees with the floor, said reclining angle L is an angle to bring the backrest to 100 to 120 degrees with the seat and said reclining angle K is an angle to bring the leg portion to 100 to 120 degrees with the seat, and said control means being controllable to manipulate the seat moving means, the backrest moving means and the leg portion moving means to thereby move the seat, the backrest and the leg portion to a selected set of reclining angles, when one of the reclining selection buttons corresponding to a desired one set of the preset reclining angles is selected by the user.

2. The chair-type massage machine according to claim 1 wherein said control means is further preprogrammed to take another set of said preset reclining angles Z, L and K, wherein said reclining angle Z is an angle to bring the seat to 20 to 40 degrees with the floor, said reclining angle L is an angle to bring the backrest 110 to 130 degrees with the seat, and said reclining angle K is an angle to bring the leg portion to 130 to 160 degrees with the seat.

3. The chair-type massage machine according to claim 2 wherein the seat, the backrest and the leg portion are pivotally movable to the angle Z, the different angle L, and the different angle K, respectively, from a state wherein the seat makes the angle Z of 20 to 40 degrees with the floor, makes the angle L of 100 to 120 degrees with the backrest, and makes the angle K of 100 to 120 degrees with the leg portion.

4. The chair-type massage machine according to claim 1 wherein said control means is further preprogrammed to take another set of said preset reclining angles positioning the backrest and the leg portion substantially horizontally with respect to the floor and positioning the seat, the backrest and the leg portion substantially flat.

5. The chair-type massage machine according to claim 1 wherein the seat moving means, the backrest moving means and the leg portion moving means are provided with respective independent drive means each controllable by the control means, the manual controller being provided with an initial position button for restoring the seat, the backrest and the leg portion to respective preset initial angles, and the control means alters the timing for the leg portion to restore the initial angle thereof based on the angle of pivotal movement of the seat and the angle of pivotal movement of the leg portion when the initial position button is manipulated to restore the seat, the backrest and the leg portion to the respective preset initial angles from an inclined state.

6. The chair-type massage machine according to claim 5 wherein after the seat has been restored to the initial angle thereof, the control means controls the drive means of the leg portion so as to restore the leg portion to the initial angle thereof.

7. The chair-type massage machine according to claim 5 wherein when the angle of pivotal movement of the leg portion relative to the initial angle thereof is a least a predetermined value smaller than the angle of pivotal movement of the seat relative to the initial angle thereof, the control means operates the drive means of the leg portion moving means to pivotally move the leg portion once in a direction opposite to the direction toward the initial angle thereof, thereby increasing the angle K, and thereafter pivotally moves the leg portion to the initial angle thereof.

8. The chair-type massage machine according to claim 5 wherein the control means alters the timing for the leg portion to restore the initial angle thereof based on the level of an outer end of the leg portion from the floor.

9. The chair-type massage machine according to claim 1 wherein the seat moving means, the backrest moving means and the leg portion moving means are provided with respective independent drive means each controllable by the control means, and the control means controls the drive means of the backrest moving means so that the speed of pivotally moving the backrest is smaller in a reclining direction than in raising direction.

10. The chair-type massage machine according to claim 1 wherein the seat moving means, the backrest moving means and the leg portion moving means are provided with respective independent drive means each controllable by the control means, and the control means prevents the seat moving means and the backrest moving means from operating at the same time when one of the reclining angles is selectively manipulated by one of the reclining selection buttons of the manual controller.

11. A chair-type massage machine comprising:

(a) a base to be placed on a floor, (b) a seat pivotally movably supported by the base for a user to be seated in, (c) a backrest pivotally movably supported by the seat at a rear end thereof for the user's back to bear on, (d) a leg portion pivotally movably supported by the seat at a front end thereof for the user's calves to bear on, (e) seat moving means for pivotally moving the seat, (f) backrest moving means for pivotally moving the backrest, (g) leg portion moving means for pivotally moving the leg portion, (h) a manual controller controllable by the user, (i) reclining selection buttons provided on the manual controller, and (j) control means electrically connected to the manual controller and structured to control the seat moving means, the backrest moving means and the leg portion moving means, said control means being preprogrammed to take a plurality of sets of preset reclining angles Z, L and K with respect to the angle of the seat, the backrest and the leg portion, respectively, wherein said reclining angle Z is an angle to bring the seat to 20 to 40 degrees with the floor, said reclining angle L is an angle to bring the backrest to 100 to 120 degrees with the seat and said reclining angle K is an angle to bring the leg portion to 100 to 120 degrees with the seat, and said control means being controllable to manipulate the seat moving means, the backrest moving means and the leg portion moving means to thereby move the seat, the backrest and the leg portion to a selected set of reclining angles, when one of the reclining selection buttons corresponding to a desired one set of the preset reclining angles is selected by the user, wherein the seat moving means, the backrest moving means and the leg portion moving means are provided with respective independent drive means each controllable by the control means, the manual controller being provided with an initial position button for restoring the seat, the backrest and the leg portion to respective preset initial angles, and the control means alters the timing for the leg portion to restore the initial angle thereof based on the angle of pivotal movement of the seat and the angle of pivotal movement of the leg portion when the initial position button is manipulated to restore the seat, the backrest and the leg portion to the respective preset initial angles from an inclined state, and wherein when the angle of pivotal movement of the leg portion relative to the initial angle thereof is a least a predetermined value smaller than the angle of pivotal movement of the seat relative to the initial angle thereof, the control means operates the drive means of the leg portion moving means to pivotally move the leg portion once in a direction opposite to the direction toward the initial angle thereof, thereby increasing the angle K, and thereafter pivotally moves the leg portion to the initial angle thereof.

* * * * *